US008622774B2

(12) United States Patent
Seifert et al.

(10) Patent No.: US 8,622,774 B2
(45) Date of Patent: Jan. 7, 2014

(54) ELECTRICAL CONTACT HAVING CHANNEL WITH ANGLED SIDEWALLS AND ROMBOID KNURL PATTERN

(75) Inventors: Kurt P. Seifert, Cortland, OH (US); William J. Palm, Warren, OH (US); Bruce J. Serbin, Canfield, OH (US); Lisa L. Flauto, Boardman, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/450,936

(22) Filed: Apr. 19, 2012

(65) Prior Publication Data

US 2013/0115830 A1 May 9, 2013

Related U.S. Application Data

(60) Provisional application No. 61/556,452, filed on Nov. 7, 2011.

(51) Int. Cl.
*H01R 4/10* (2006.01)

(52) U.S. Cl.
USPC ..... 439/882

(58) Field of Classification Search
USPC ..... 439/877, 882, 203
See application file for complete search history.

(56) References Cited

U.S. PATENT DOCUMENTS

| | | | | |
|---|---|---|---|---|
| 3,549,786 | A | 12/1970 | Kuo | |
| 3,735,331 | A | 5/1973 | O'Donnell et al. | |
| 3,812,448 | A | 5/1974 | Haitmanek | |
| 3,953,103 | A | 4/1976 | Mathis | |
| 4,142,771 | A | 3/1979 | Barnes et al. | |
| 5,252,088 | A | 10/1993 | Morello et al. | |
| 5,558,545 | A | 9/1996 | Staab et al. | |
| 6,749,457 | B2 | 6/2004 | Sakaguchi et al. | |
| 7,210,858 | B2 | 5/2007 | Sago et al | |
| 7,722,416 | B2 | 5/2010 | Gump et al. | |
| 8,177,591 | B2 * | 5/2012 | Okamura et al. | 439/877 |
| 8,337,262 | B2 * | 12/2012 | Ono et al. | 439/877 |
| 2005/0273122 | A1 | 12/2005 | Theroux et al. | |
| 2011/0083324 | A1 | 4/2011 | Martauz et al. | |
| 2012/0028494 | A1 * | 2/2012 | Ono et al. | 439/442 |
| 2013/0115828 | A1 * | 5/2013 | Seifert et al. | 439/877 |

FOREIGN PATENT DOCUMENTS

| | | |
|---|---|---|
| EP | 0 544 521 | 6/1993 |
| JP | 2003-243057 | 8/2003 |
| WO | 2009-128344 | 10/2009 |

OTHER PUBLICATIONS

International Search Report dated Nov. 27, 2012.
Machine English translation of WO2009-128344, Oct. 22, 2009.

* cited by examiner

*Primary Examiner* — Phuong Dinh
(74) *Attorney, Agent, or Firm* — Robert J. Myers

(57) ABSTRACT

An electrical contact includes at least one grooved channel defined in an interior surface of the electrical contact along at least a portion the electrical contact disposed along a longitudinal axis. The portion is configured to axially receive a lead of a wire cable for attachment thereto and thereby allow the attached lead to at least engagingly make contact against a recessed surface of the grooved channel. The grooved channel has a depth and includes at a least one sidewall extending along the depth. The sidewall includes at least one section that angularly extends from the interior surface to a point recessed from the interior surface disposed on the sidewall along the depth.

17 Claims, 8 Drawing Sheets

ELECTRICAL CONTACT HAVING CHANNEL WITH ANGLED SIDEWALLS AND ROMBOID KNURL PATTERN

RELATED DOCUMENTS

This application claims priority to provisional application U.S. Ser. No. 61/556,452 filed on 7 Nov. 2011. This application is also related to U.S. Ser. No. 13/288,561 entitled "ELECTRICAL CONTACT HAVING KNURL PATTERN WITH RECESSED RHOMBIC ELEMENTS THAT EACH HAVE AXIAL MINOR DISTANCE," filed on 3 Nov. 2011 that is co-owned by the assignee of this application and is incorporated by reference herein.

TECHNICAL FIELD

This invention relates to an electrical contact that includes a serration and a knurl pattern defined in an internal surface, more particularly, the electrical contact includes a serration that has outwardly angled sidewalls and a knurl pattern that has a plurality of recessed elements that contain an axial minor distance defined between a first pair of opposing, generally axial inner corners that is less than a major distance defined between a second pair of opposing inner corners.

BACKGROUND OF INVENTION

It is known to use grooved serrations disposed in an interior surface of a terminal to enhance the mechanical and/or electrical connection between a wire cable that is attached to the terminal.

A number of conventional cross-sectional grooved serration profiles have been employed in the wiring art that include hardened teeth forms, irregular surfaces, saw tooth shapes, square or rectangular shapes, ridge-like tooth forms, and serrations with undercut sidewalls. Another type of conventional serration (1) defined in a terminal (2) used for aluminum cable wiring applications is shown in prior art FIG. 1. The serration (1) includes angular sidewalls (3) that respectively have a ramp angle Θ. The ramp angle Θ has an angular value of 84 degrees in relation to a plane (4) defined along a recessed surface (5) of the serration (1). With the ramp angle theta being 84 degrees the sidewalls (2) are angularly disposed at a corresponding draft angle α having an angular value of 6 degrees. The draft angle α facilitates the stamping of the serration (1) in the terminal (2) during the manufacturing process. The steep ramp angle Θ, however, may undesirably damage the wire strands of the aluminum cable when portions of the wire strands of the lead of the aluminum wire cable extrude into serration (1) when a crimp of the aluminum cable and the terminal (2) is formed. If a wire strand is nicked or cut while extruding in and filling the serration (1), this may undesirably reduce the surface area contact between the wire strand and the serration (1) which may undesirably increase the resistance of the crimp. Aluminum wire cable is becoming increasingly desired for use in motorized vehicular applications due to decreased weight and cost over similar copper-based wire cables. A vehicle using the aluminum wire cable may have less mass which may then desirably provide for increased fuel economy of the vehicle. A serration shape is desired that at least maintains or preferably enhances the mechanical and electrical properties in contrast to previously described conventional serrations of a crimp formed between the aluminum wire cable and the terminal that also allows for high-quality, high-speed manufacturing of the terminal from sheet metal stock.

Thus, what is needed is an electrical contact that includes a serration having a serration shape that maintains or enhances the mechanical and electrical properties of a crimp connection formed between an aluminum wire conductor and the electrical contact that also allows for high-quality, high-speed manufacturing of the electrical contact.

SUMMARY OF THE INVENTION

At the heart of the present invention is the discovery of a serration shape defined in an interior surface of an electrical contact that takes into consideration three factors in combination to allow for a high-quality, high-speed manufacturing of the electrical contact, or terminal. One factor is the desire to have a serration shape that decreases the chance for undesired nicks and cuts in the wire strands of the wire cable so there is decreased resistance within the crimp formed between the wire cable and the terminal. Less resistance means electrical current may flow more freely through the wire cable/electrical contact connection. A second factor is the desire that the serration shape be formed in a manner that allows material growth to occur to the terminal during the manufacturing process while still maintaining proper terminal alignment at downstream tooling stations during manufacture of the terminal in the terminal manufacturing die. Misalignment of the terminal in downstream tooling stations forms undesired terminal quality defects due to misalignment of other features manufactured in to the terminal. Certain cross-sectional serration shapes or a serration having too deep or too shallow of a depth may further increase the probability for misalignment in the terminal manufacturing die. A third factor is also a desire to produce a serration shape in conjunction with a desired knurl pattern that further enhances the mechanical and electrical properties of a crimp formed between the wire cable and the terminal in the same high-speed terminal manufacturing process.

According to one embodiment of the invention, then, an electrical contact includes a grooved serration defined in an interior surface of the electrical contact along at least a portion of a length of the electrical contact. The grooved serration has a depth from the interior surface to a recessed surface of the serration and further includes at least one sidewall disposed along the depth. The sidewall includes at least one section that angularly extends from the interior surface to a point on the sidewall recessed from the interior surface disposed along the depth.

The angularly-sided grooved serration may also be formed in combination with a knurl pattern in the interior surface of the electrical contact. The knurl pattern includes rhomboid-shaped recessed elements. Each rhomboid-shaped recessed element in the knurl pattern has an axial minor distance.

An electrical connection system includes the electrical contact that contains the angularly-sided grooved serration and/or the knurl pattern having the rhomboid-shaped recessed elements. The electrical connection system may be associated with a cable harness used in a motorized vehicle application.

Further features, uses and advantages of the invention will appear more clearly on a reading of the following detailed description of the preferred embodiments of the invention, which is given by way of non-limiting example only and with reference to the accompanying drawings.

BRIEF DESCRIPTION OF THE DRAWINGS

This invention will be further described with reference to the accompanying drawings in which.

DETAILED DESCRIPTION

Electrical contacts and attached wire cables are a mainstay of electrical systems disposed in motorized vehicles, trucks, boats and airplanes. As these transportation products continue to have strong market demand with consumers worldwide it is also increasingly desirable to manufacture these transportation products with less mass that may provide for desired increased fuel economy.

Figure 1:
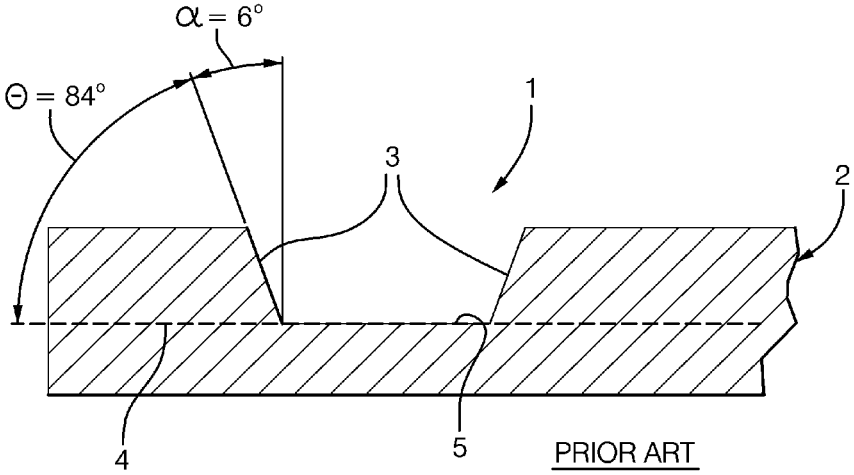
PRIOR ART FIG. 1
FIG. 1 shows a cross-sectional view of a terminal having a conventional serration that has a sloped surface with an 84 degree ramp angle in relation to a recessed surface of the serration that allows for a 6 degree draft angle.
Figure 2:
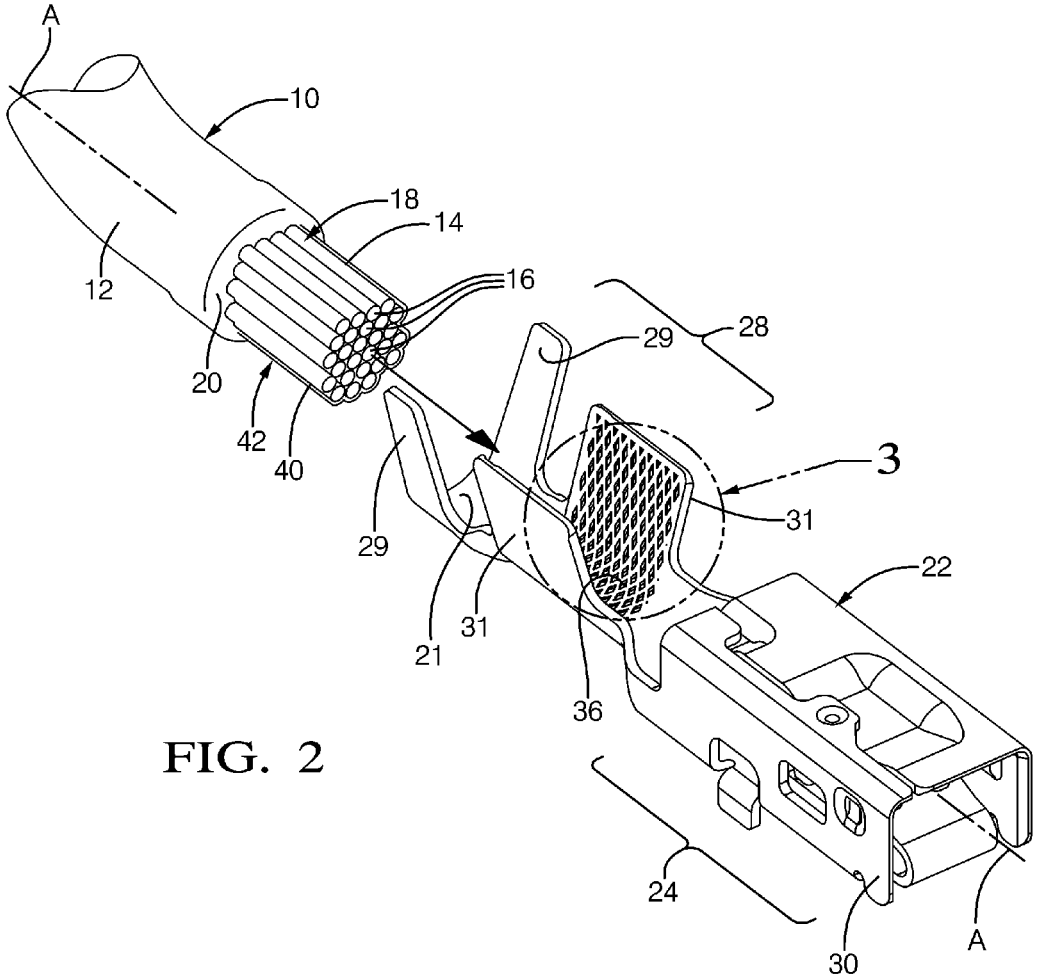
FIG. 2 shows a perspective view of an electrical contact that includes a knurl pattern along a portion of a length of the electrical contact receiving a wire cable according to the invention.

To this end, and in accordance with this invention, referring to FIG. 2, a wire conductor, or wire cable 10 is disposed along a longitudinal axis A. Cable 10 has an insulative outer cover 12 and an aluminum-based inner core 14. The term "aluminum-based" as used in this document herein is defined to mean pure aluminum or an aluminum alloy where aluminum is the main metal in the alloy. Outer cover 12 surrounds inner core 14. Inner core 14 is composed of individual wire strands 16 that may be axially disposed in inner core 14 when inner core 14 is received in electrical contact 22. Alternately, inner core may be constructed of a plurality of individual wire strands that are bundled and twisted together. When the wire strands are twisted and bundled together, the lead may be axially received into the electrical contact, but the twisted wire strands may not be axially disposed therein. Wire strands 16 are useful to provide flexation of cable 10 when cable 10 is installed in a wiring application (not shown), such as may be the case during the manufacture of a vehicle. Alternately, the inner core of the wire cable may be formed of a single, solid wire strand. An end portion (not shown) of outer cover 12 of cable 10 is removed to expose a portion of inner core 14. Exposed portion of inner core 14 is a lead 18 of wire cable 10. Lead 18 extends from an axial edge 20 of outer cover 12.

Figure 3:
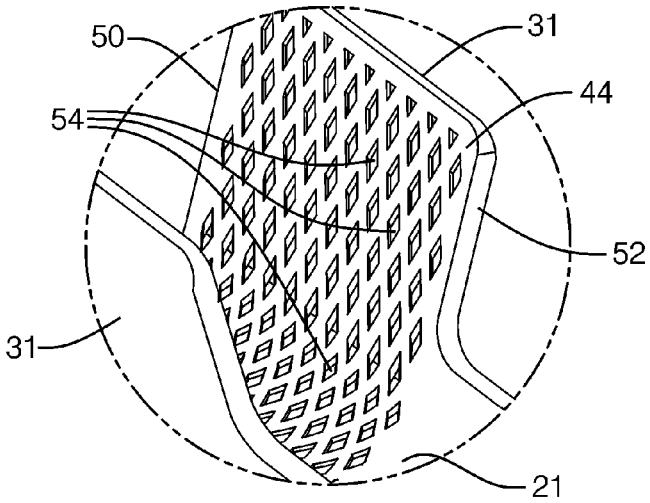
FIG. 3 shows a magnified view of the knurl pattern of FIG. 2, and details thereof.

A copper-based terminal or electrical contact 22 includes a mating end 24 and an open wing end 28. Alternately, the electrical contact may be formed from any electrically-conductive material. Wing end 28 receives lead 18 along axis A. Wing end 28 includes a pair of insulation wings 29 that are axially spaced apart from a pair of core wings 31. Insulation wings 29 are disposed aft of core wings 31 along a base 21 of electrical contact 22 that receives wire cable 10. The term "copper-based" as used in this document herein is defined to mean pure copper, or a copper alloy where copper is the main metal in the alloy. Electrical contact 22 may be received into a connector (not shown) that may include a plurality of electrical contacts (not shown) that are part of wiring harness (not shown) used in a vehicle (not shown) and the connector (not shown) may mate with a corresponding mating connector (not shown) used in the motorized vehicle. Mating end 24 contains a female box electrical contact 30 portion and as is known and used in the electrical contact and wiring arts. Female box contact 30 may be received into a corresponding male electrical contact (not shown), such as may be found in the corresponding mating connector (not shown) disposed in the vehicle (not shown). Female box contact 30 electrically joins an electrical signal carried on inner core 14 with another electrical circuit attached with the corresponding male receiving electrical contact. Alternately, the female mating end may be a male mating end and the electrical contact may comprise other additional sections disposed intermediate the wing and the mating end. Insulation wings 29 and core wings 31 respectively angularly extend outwardly away from base 21 of electrical contact 22. Base 21 preferably has an arcuate shape in the neutral state. The neutral state of electrical contact 22 is the form of electrical contact 22 after initial construction and before a crimp connection 46 is formed, as best illustrated in FIGS. 2 and 3. Arcuate base 21 generally conforms to a shape of lead 18 when wire cable 10 is received in electrical contact 22. Insulation wings 29 are configured to crimp to insulative outer cover 12 and core wings 31 are configured to crimp to lead 18.

Electrical contact 22 is chosen for a given electrical application such that wing end 28 is of a sufficiently large size to receive lead 18 and portion of outer cover 12 adjacent to lead 18 to allow for an effective crimp between electrical contact 22 and cable 10. A core wing 31 is sized to sufficiently wrap around, cover, and engage against at least a portion of lead 18 when cable 10 is crimped to electrical contact 22. Core wing 31 includes an interior surface, or abutting surface 36 that engages at least a portion of inner core 14 of lead 18 when cable 10 is crimped to electrical contact 22 to provide electrical connection between cable 10 and electrical contact 22. Preferably, core wing 31 is sized to lead 18 so that a knurl pattern 44 engages the entire axial length of lead 18 when lead 18 is received in electrical contact 22 and a rearward edge 50 of electrical contact 22 is disposed adjacent to edge 20 of insulative outer cover 12 when crimp connection 46 is formed.

A fluid conformal coating 40 is disposed along at least an outer surface of lead 18 and an end 38 of lead 18. Additionally, coating 40 is also applied over edge 20 and extends on to a portion of insulative outer cover 12 adjacent lead 18. Thus, a seal covering 42 of fluid conformal coating 40 entombs lead 18 so as to provide a corrosion-resistant protective layer for lead 18 of cable 10 when wire cable 10 is received into wing end 28 of electrical contact 22. "Fluid" is defined as "being able to flow." Seal covering 42 may advantageously aid in the preventing the formation of galvanic corrosion in crimp connection 46. The viscosity of coating 40 may be altered to allow coating 40 to properly flow onto cable 10 so as to achieve a sufficient thickness of coating 40 to completely cover at least the outside surface of lead 18. Seal covering 42 of fluid conformal coating 40 may be applied to cable 10 by dripping, spraying, electrolytic transfer, and brush and sponge applications, and the like. One such seal covering is described in United States Publication No. 2011/0083324 entitled SEALED CRIMP CONNECTION METHODS filed on 16 Sep. 2010, which is incorporated by reference herein. Alternately, the lead may be configured to electrically and mechanically attach to the electrical contact being void of any applied fluid coating.

Figure 4:
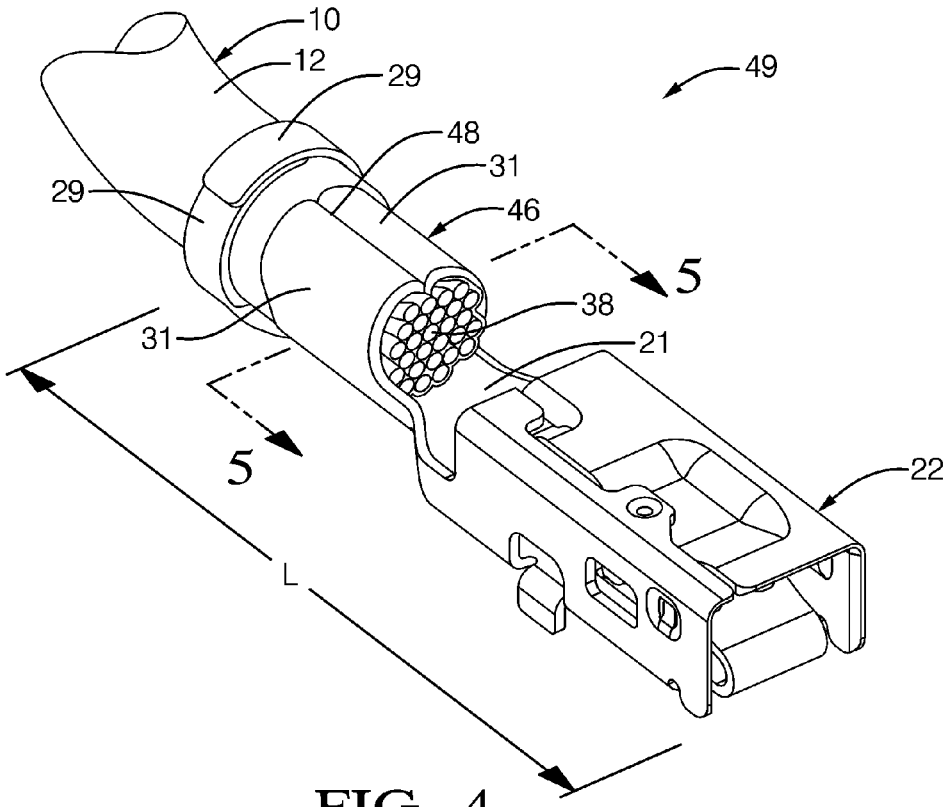
FIG. 4 shows a crimp connection that attaches the wire cable of FIG. 2 to the electrical contact of FIG. 3.
Figure 5:
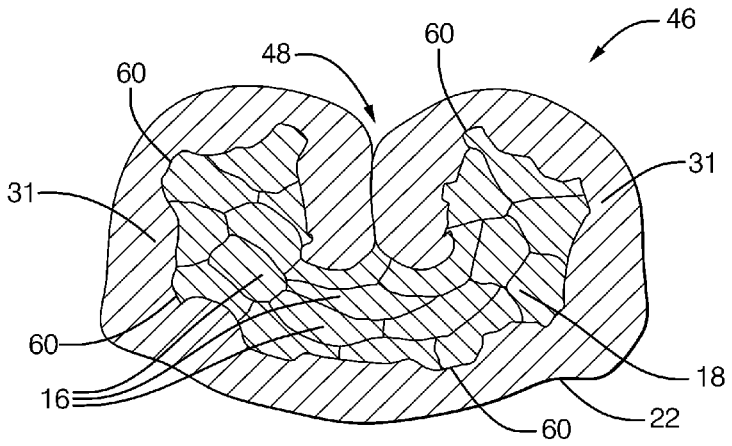
FIG. 5 shows a cross-sectional view of the crimp connection of FIG. 4, through the lines 5-5.

Referring to FIG. 3, electrical contact 22 includes knurl pattern 44. Knurl pattern 44 is defined within abutting surface 36 of core wing 31 of electrical contact 22 along a portion of a length L of electrical contact 22. Length L is axially disposed along axis A. Referring to FIGS. 4-5, when electrical contact 22 is attached to wire cable 10 to form crimp connection 46, knurl pattern 44 engagingly contacts against at least the outer surface of lead 18. Knurl pattern 44 may be formed, and stamped in to abutting surface 36 by using a die press, as is known in the electrical contact and wiring arts. Crimp connection 46 includes a seam 48 formed intermediate a rearward and forward edge 50, 52 of core wing 31. Crimp connection 46 is part of a wire assembly 49 that includes wire cable 10 and electrical contact 22.

Figure 6:
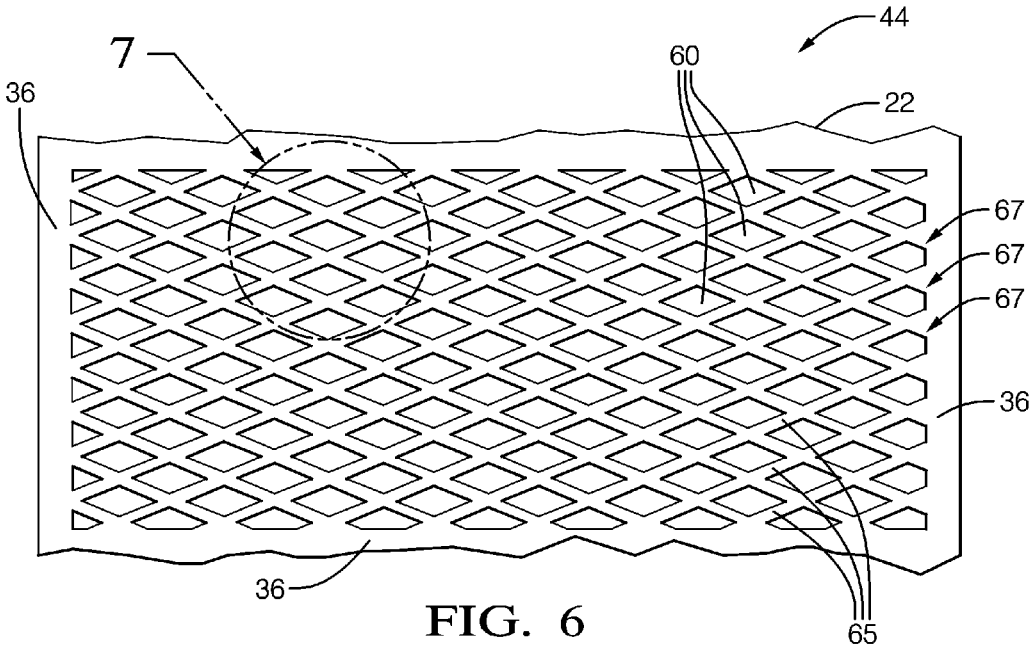
FIG. 6 shows a magnified view of the knurl pattern of FIG. 3, and details thereof.
Figure 7:
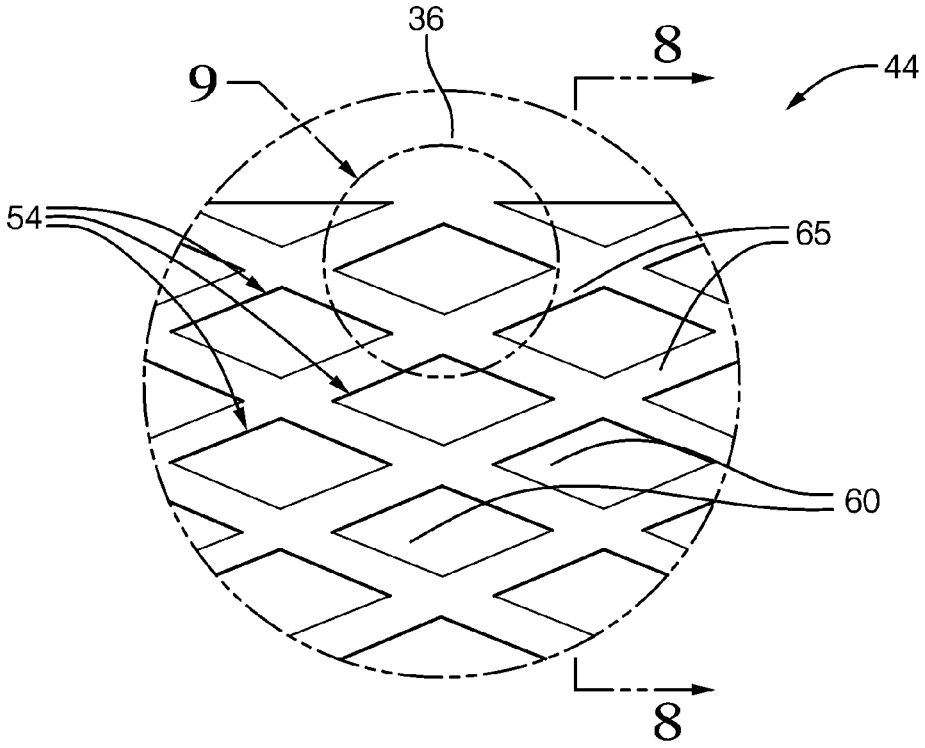
FIG. 7 shows a magnified view of recessed, rhomboid-shaped elements of the knurl pattern of FIG. 6.
Figure 8:
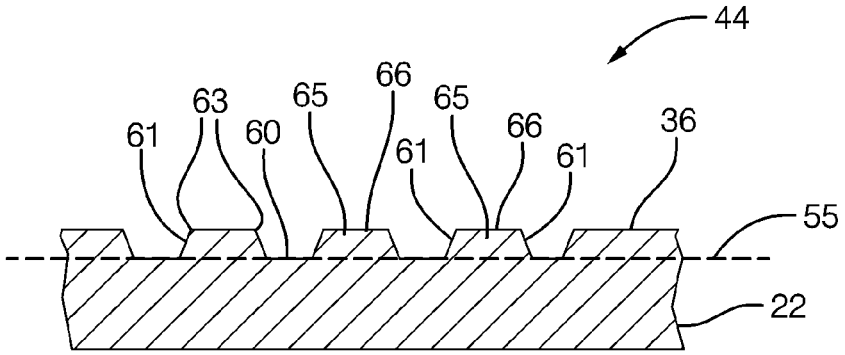
FIG. 8 shows a cross-sectional view of the recessed, rhomboid-shaped elements of FIG. 7 that include inclined ramp sidewalls, taken through the lines 8-8.
Figure 9:
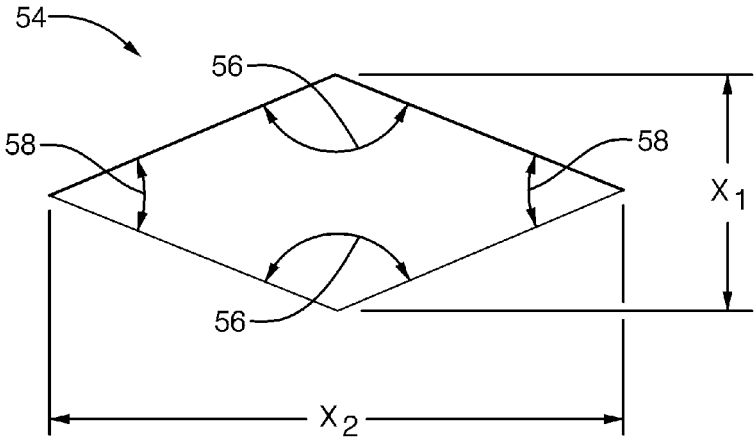
FIG. 9 shows a magnified view of a single, recessed rhomboid-shaped element in the plurality of recessed, rhomboid-shaped elements of FIG. 7.

Knurl pattern 44, referring to FIGS. 6-9, includes a plurality of elements 54 that extend along a floor 55 underlying abutting surface 36. A recessed surface 60 of each element 54 is adjacently disposed to floor 55. Floor 55 is spaced apart and recessed from abutting surface 36. Raised portions 65 are disposed in-between the elements 54 and have a top planar surface 66 that is generally planar with the surrounding abutting surfaces 36. Each of the plurality of elements 54 includes a plurality of sidewalls 61. Edges 63 of respective elements 54 are formed at an interface between sidewalls 61 and top planar surfaces 66 of raised portions 65. Each element 54 has a perimeter edge formed from a plurality of edges 63 that surround each element 54. Each sidewall in the plurality of sidewalls 61 for each element in the plurality of elements 54 extends from recessed surface 60 in an inclined, angled direction towards top planar surface 66 and transition to top planar surface 66 such that edges 63 are formed. Thus, sidewalls 61 are inclined ramps when viewed in cross section, as best illustrated in FIG. 8. Advantageously, plurality of inclined sidewalls 61 assist removal of the die from electrical contact 22 when knurl pattern is stamped. Preferably, the incline ramps of the sidewalls have draft angle that is an acute angle in relation to a plane defined perpendicular to floor 55. Alternately, the plurality of sidewalls for each element in the plurality of elements may be disposed in a direction perpendicular to the floor. Recessed surface 60 for each element 54 is generally parallel with abutting surface 36 and with axis A. Raised portions 65 adjacently surround each element 54 in knurl pattern 44, as best illustrated in FIGS. 7 and 8. The top planar surfaces 66 of raised portions 65 transitionally communicate with the surrounding abutting surface 36, as best illustrated in FIG. 6. Alternately, the planar top surfaces of the raised portions may be recessed so that the planar top surfaces are disposed intermediate the floor and the surrounding abutting surface. Edges 63 are effective to fracture the aluminum oxides disposed on lead 18 as crimp connection 46 is formed. The structure interrelationships of sidewalls 61, edges 63, and raised portions 65 are best illustrated in FIG. 8. Floor 55 has a spaced, generally parallel relationship with abutting surface 36. Each recessed surface 60 has a shape that includes a first pair of opposing, generally axial inner corners 56. First pair of opposing inner corners 56 define a first, or axial minor distance $x_1$ therebetween. A second pair of opposing inner corners 58 different from first pair of opposing inner corners 56 define a second, or major distance $x_2$ therebetween. Major distance $x_2$ has a bisecting, perpendicular relationship to minor distance $x_1$, as best illustrated in FIG. 9. Axial minor distance $x_1$ is less than major distance $x_2$. Recessed surface 60 for each element 54 has a surface area that forms a rhombus shape. Alternately, the axial minor distance may be substantially axial with axis A and the major distance is perpendicular to the substantial axial minor distance. For each element 54, first pair of axial opposing inner corners 56 respectively have an angular value that is greater than the angular value of the respective second pair of opposing inner corners 56. Preferably, an inner corner of the first pair of axial opposing inner corners 56 has an obtuse angular value and an inner corner of the second pair of opposing inner corners 58 has an acute angular value, as best illustrated in FIG. 9. In a further alternate embodiment, an inner corner of the first pair of axial opposing inner corners has an obtuse angular value that may be greater than 100 degrees.

Figure 10:
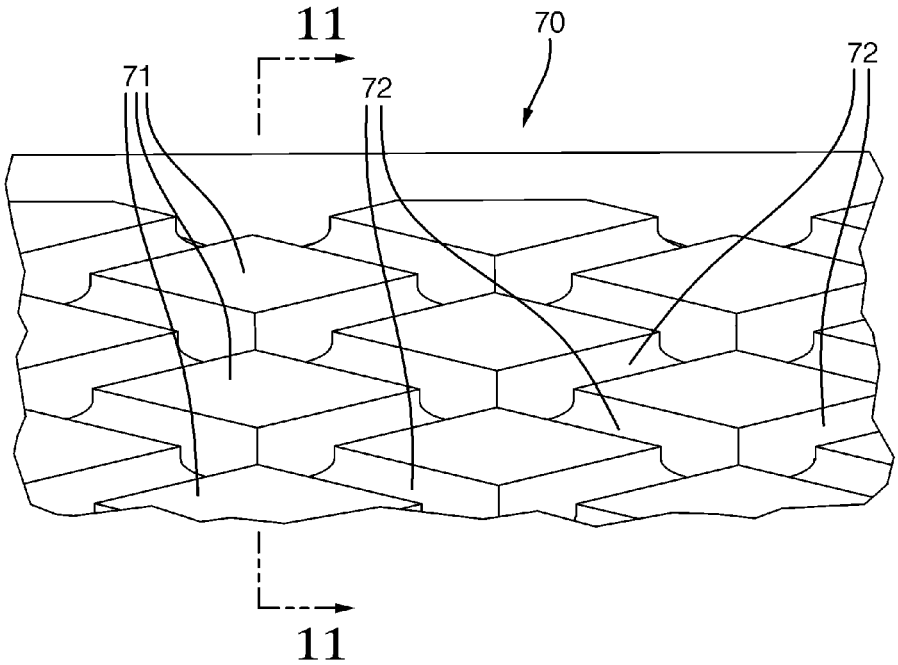
FIG. 10 shows an isometric three-dimensional view of corresponding raised protrusion elements associated with a die of the press tool used to construct the recessed, rhomboid-shaped elements of FIG. 6 in an interior surface of the electrical contact.
Figure 11:
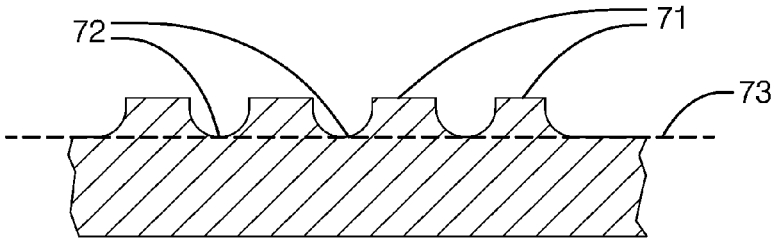
FIG. 11 shows a cross-sectional view of the corresponding elements of the die of the press tool of FIG. 10, along the lines 11-11.

Referring to FIGS. 10-11, a corresponding knurl pattern 70 is associated with a die of a die press (both not shown). The die press may be any kind of die press that is effective to produce knurl pattern 70 as is known and used in the electrical contact and wiring arts. To construct plurality of recessed elements 54 in knurl pattern 44 of electrical contact 22 raised rhomboid protrusions 71 of knurl pattern 70 are utilized on the die used in the die press. Grooves 72 surround each protrusion 71 in knurl pattern 70 disposed on the die. The die containing knurl pattern 70 is constructed from hardened metal that is harder than the electrical contact or terminal, such as using a hardened carbide steel. Grooves 72 preferably have a deeper depth than a depth of raised portions 65 of knurl pattern 44 as measured from floor 55. Grooves 72 have a depth from the surface of the rhomboid protrusions 71 to a floor 73 in the die, as best illustrated in FIG. 11.

The knurl pattern 44 of electrical contact 22 is not in use when wire cable 10 is not attached, as best illustrated in FIGS. 2 and 3.

Knurl pattern 44 of electrical contact 22 is in use when knurl pattern 44 engages lead 18 to form crimp connection 46, as best illustrated in FIGS. 3 and 4. Crimp connection 46 may be formed by a press as is known in the electrical contact and wiring arts. When crimp connection 46 is being formed, plurality of elements 54 are urged by a force as applied by the press to engage against aluminum lead 18 such that portions of aluminum lead 18 extrude into plurality of elements 54. The edges 63 in the plurality of elements 54 in combination with the axial minor distance $x_1$ and major distance $x_2$ rhombus shape orientation further assist to break up the aluminum oxides along the entire outer surface of lead 18 of cable 10 so as to increase the electrical and mechanical robustness of crimp connection 46.

While not limited to any particular theory, it has been observed, that using plurality of elements 54 having the orientation of axial minor distance $x_1$ and major distance $x_2$ assists to keep elements 54 open for a longer period of time during the crimping of electrical contact 22 to lead 18. Portions of aluminum lead 18 extrude into elements 54 against recessed surfaces 60 so that elements 54 engagingly close against portions of the extruded aluminum lead 18 so that the voids, as previously discussed herein, do not occur. Because major axis distance $x_2$ is perpendicular to lead 18, a greater contact surface area for any particular wire strand 16 is more apt to have aluminum oxides disposed on individual wire strand 16 broken up and fractured while also being extruding into recessed elements 54. A greater contact surface area of pure aluminum on at least an outer surface of lead 18 making mechanical and electrical contact with the surfaces 36, 60, 61, 63, 66 of knurl pattern 44 on core wing 31 ensures a more reliable and robust electrical connection. The greater surface area contact also results in enhanced mechanical interlock between lead 18 and core wing 31 that assists to maintain the robust electrical contact between lead 18 and electrical contact 22 in crimp connection 46. This greater surface area contact between surfaces 36, 60, 61, 63, 66 and lead 18 is best illustrated in FIGS. 5 and 8. Thus, knurl pattern 44 advantageously allows for a maximum electrical and mechanical connection between lead 18 and electrical contact 22 when crimp connection 46 is formed. Moreover, it is also important that core wings 31 are crimped in a manner so that as crimp connection 46 is formed to a final state from the neutral state, core wing 31 maintains a generally arcuate form during the formation of crimp connection 46. The final state of core wing 31 is when core wing 31 is formed in crimp connection 46, as best illustrated in FIG. 4. Maintaining the arcuate form of core wing 31 during the crimping process allows elements 54 to bendingly remain sufficiently open for a longer time period such that portions of aluminum lead 18 extrude into elements 54 before elements 54 engagingly close partially to trap the extruded portions of aluminum lead 18 within the closed elements 54, as best illustrated in FIG. 5.

Additionally, as recessed elements 54 are formed in diagonal rows 67 when knurl pattern 44 is formed in abutting surface 36 of core wing 31, the major distances $x_2$ collectively cover the width of core wing 31 such that at least the entire surface area of lead 18 is impacted by plurality of elements 54 across the length and width of knurl pattern 44 on core wings 31 to ensure a robust electrical connection of wire cable 10 and electrical contact 22. The perimeter edges of the elements 54 in knurl pattern 44 are effective to provide increased ability for knurl pattern 44 to fracture aluminum oxides on lead 18 when crimp connection 46 is formed.

It has been observed when crimp connection 46 is analyzed and core wings 31 are unwrapped from lead 18, a substantial portion of knurl pattern 44 is left impressed in the outer surface of lead 18 of wire cable 10. For many analyzed crimp connections, one hundred percent (100%) of the knurl pattern is left impressed on the leads of the respective wire cables.

Figure 12:
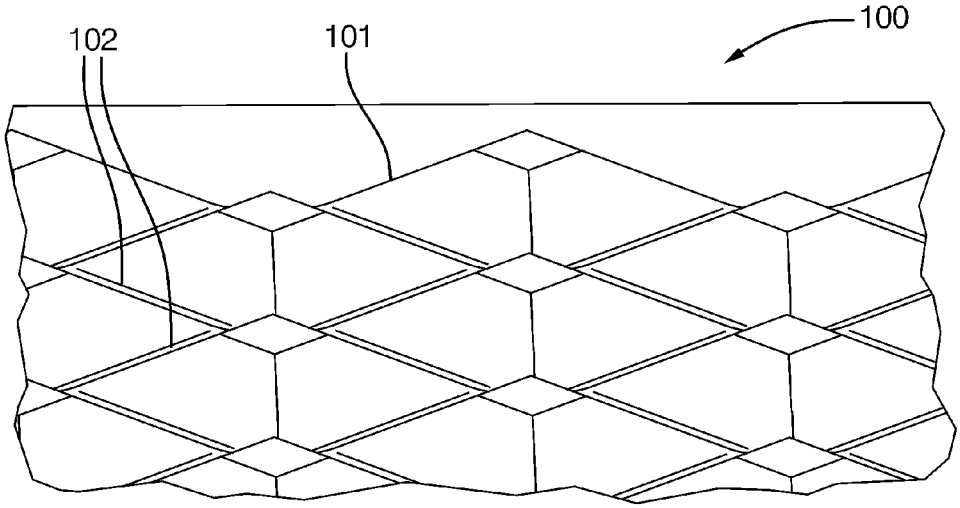
FIG. 12 shows an isometric three-dimensional view of corresponding elements associated with a die of a press tool used to make recessed, rhomboid-shaped pyramidal elements in an interior surface of an electrical contact, according to an alternate embodiment of the invention.

Alternately, referring to FIG. 12, a die employs pyramidal rhomboid-shaped protrusions 101 and associated adjacent grooves 102 may be utilized. Protrusions 101 each have a flattened truncated top. When the die employing pyramidal protrusions 101 and associated grooves 102 is used to stamp a recessed knurl pattern on the core wings and base of the electrical contact, a plurality of recessed pyramidal rhomboid-shaped elements is defined in the interior surface of the electrical contact. Each flattened truncated top is in each recessed pyramidal rhomboid-shaped element is disposed adjacent a floor of the interior surface of the electrical contact. The die of the embodiment of FIG. 13 is made from similar materials as the die of the embodiment shown in FIGS. 10 and 11 as previously discussed herein.

Figure 13:
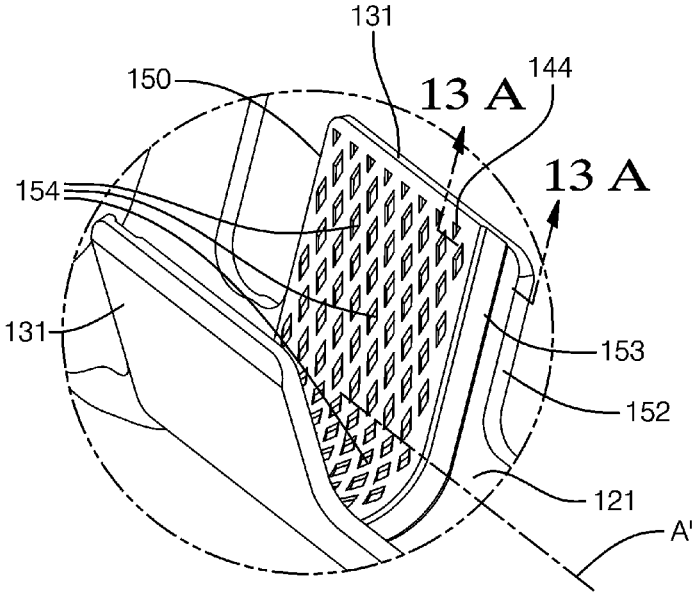
FIG. 13 shows an electrical contact with the knurl pattern of FIG. 3 and a single, grooved, angular serration according to another alternate embodiment of the invention.
Figure 13A:
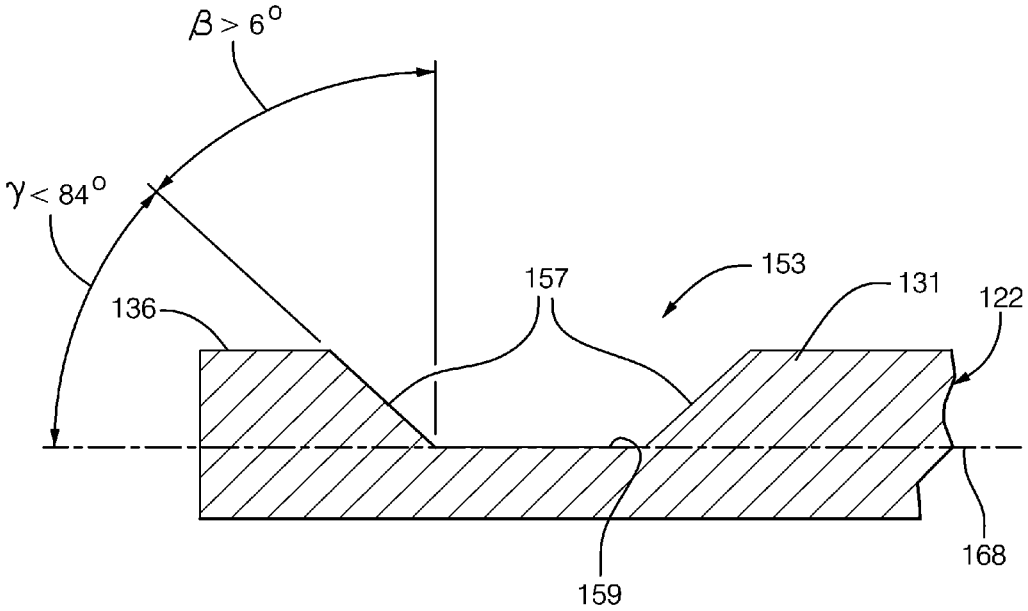
FIG. 13A shows a cross-sectional view of the angular serration of FIG. 13, and $\gamma$ ramp angle and $\beta$ draft angle details thereof.

Turning now to another alternate embodiment of the invention, referring to FIGS. 13 and 13A, an electrical contact 122 includes a single grooved channel 153 disposed forward of a knurl pattern 144 closer to forward edge 152 of core wing 131. Elements in FIGS. 13 and 13A that are similar to elements illustrated in the embodiment of FIGS. 2-9 have reference numerals that differ by 100. Channel 153 is disposed along a width of core wing 131 perpendicular to axis A' similar to axis A and is defined in abutting surface 136. Knurl pattern 144 is disposed closer to rearward edge 150 of core wing 131. Knurl pattern 144 includes plurality of recessed elements 154. Channel 153 includes angled sidewalls 157 that extend from abutting surface 136 to a planar recessed surface 159 of channel 153. A plane is defined along recessed surface 159 that is parallel with abutting surface 136. Angled sidewalls 157 form an inclined ramp from recessed surface 159 to abutting surface 136. The inclined ramp of each sidewall 157 has a ramp angle $\gamma$ in relation to a floor 168. Ramp angle $\gamma$ has an angular value in a range of an acute angle with a maximum value being less than 84 degrees. Having this acute angle value with a maximum value of less than 84 degrees is advantageous to minimize undesired damage to the wire strands during the crimping process for the malleable aluminum material while also ensuring a high-quality mechanical and electrical connection of the lead to the electrical contact. Preferably, the ramp angle $\gamma$ has a value that is in a range from 15 to 60 degrees. Even more preferably, the ramp angle $\gamma$ has a value that is in a range of 30 to 45 degrees. Correspondingly, the draft angle $\beta$ has a value that is greater than 6 degrees. For any given application the fabrication of the electrical contact yields the ramp angle $\gamma$ when added or summed with the draft angle $\beta$ totals 90 degrees in relation to floor 168. Generally, the angular values for $\gamma$ and $\beta$ would the same for each angular wall in the serration. Alternately, the values of $\gamma$ and $\beta$ for each angular wall in the serration may have different values.

Channel 153 is in use when a lead of a wire conductor is received in the core wing and the aluminum wire conductor is crimped to the electrical contact as has been previously described herein for the embodiment of FIGS. 2-9. Portions of the aluminum lead are pressured under the force of a die press to extrude laterally to fill channel 153. It has been observed that the portions of aluminum lead substantially fill the grooved serration and engage against sidewalls and recessed surface when the crimp connection is formed. The inclined ramp sidewalls have been found to provide a more gradual transition for the aluminum lead extrusion into the serration to gain the desired mechanical strength for the crimp connection without damaging the wire strands of the wire conductor.

It has been observed that the forward positioned serration, as best illustrated in FIG. 13, in contrast to a rearward positioned serration, may be better suited to provide the desired growth of the terminal material when the serration and/or the serration/knurl pattern are impressed in the material stock by the stamp tooling since the growth that the stamp tooling imparts is not also further restrained by the stamp tooling. In addition, it has also been observed the combination of rhombic knurl pattern in combination with the single forward serration should cover a majority of the interior surface of the crimp wings for a maximized mechanical and electrical connection of the wire cable and the electrical contact while an amount of interior surface of the electrical contact that contains no rhombic knurl pattern and serration features should be minimized.

Figure 14:
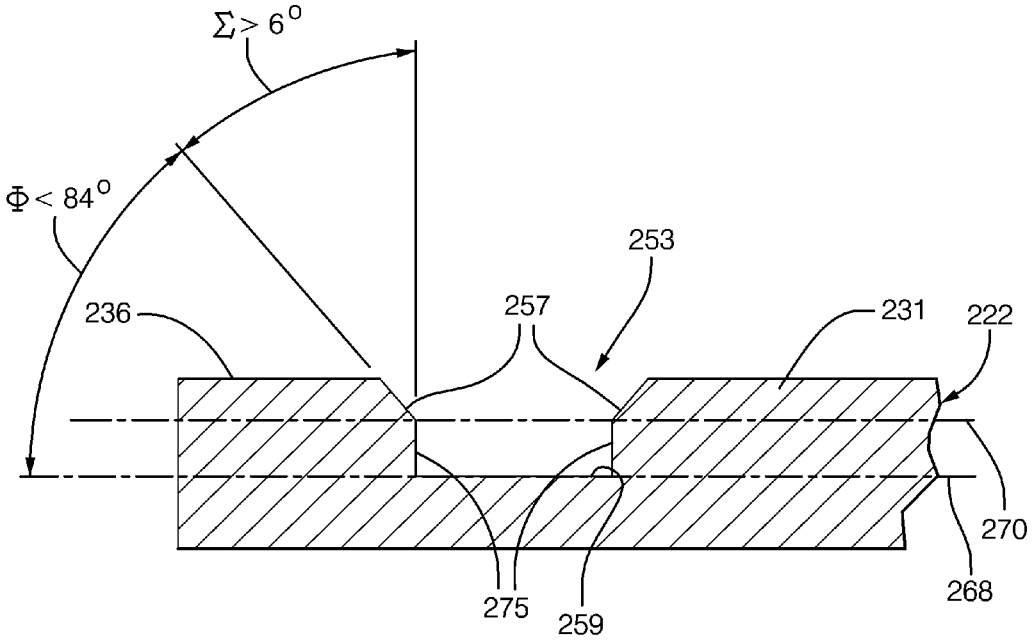
FIG. 14 is a cross-sectional view of a serration where a portion of a sidewall of the serration has an angular sidewall that includes a $\phi$ ramp angle and a $\Sigma$ draft angle details thereof, according to yet another alternate embodiment of the invention.

Referring to FIG. 14, in another alternate embodiment, and electrical contact 222 has a serration 253 that includes sidewalls. The sidewalls include a vertical wall section 275 that transitions in to an angled wall section 257. Angled wall portion 257 is disposed in an outbound direction from planar recessed surface 259 of serration 253. Angled wall portion 257 extends from abutting surface 236 of electrical contact 222 downwardly to a point along a depth of serration 253. The depth of serration 253 is measured from abutting surface 236 to planar recessed surface 259. The point along the depth is where angled wall portion 257 transitions into vertical wall section 275. A plane 270 is defined along these points that is perpendicular with floor 268 and abutting surface 236. The aluminum lead fills serration 253 in a similar manner to that of channel 153 as previously described above. Alternately, the vertical wall may also be an angular wall that may have a different slope then angled wall portion 257 to at least ensure easy removal of the punch when the serration is stamped. Preferably, ramp angle $\phi$ is less than 84 degrees and draft angle $\Sigma$ is greater than 6 degrees. In other embodiments, the slope of the walls that form the vertical wall section 275 as illustrated in FIG. 14 may have a draft angle that is about 6 degrees. For any given application the fabrication of the electrical contact yields the ramp angle $\phi$ when added or summed with the draft angle $\Sigma$ totals 90 degrees in relation to floor 268. Generally, the angular values for $\phi$ and $\Sigma$ would the same for each angular wall in the serration. Alternately, the values of $\phi$ and $\Sigma$ for each angular wall in the serration may have different values.

Figure 15:
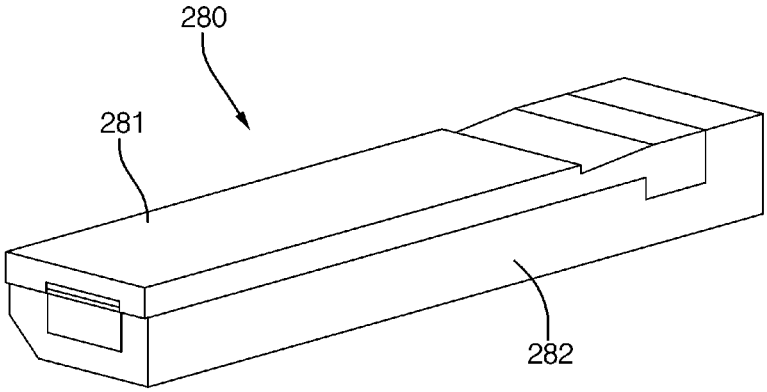
FIG. 15 is an isometric view of a two-piece combination punch used to form the knurl pattern and angular serration in the electrical contact of FIGS. 13 and 13A.

A two-piece combination die punch 280, as best illustrated in FIG. 15, is preferably employed to stamp channel 153 and knurl pattern 144 in the electrical contact 122. Die punch 280 includes a top piece, or portion 281 and a bottom piece, or portion 282 that assembles together in a single tool. Die punch 280 is useful to consistently stamp a knurl pattern and serration at preferred widths and depths to ensure a high-quality terminal construction in a high-volume manufacturing process along a high-speed manufacturing line. The two piece punch is useful as portion 282 may be swapped out and substituted with another punch that may include other serration elements to produce an electrical contact that does not contain knurl pattern 44.

Alternately, the inner core of the wire cable may be constructed from a non-aluminum, electrically conductive material. More generally, the electrical contact may be constructed from any kind of suitable electrically conductive material. For example, the wire cable may have an inner core formed with a copper-based metal.

Still yet alternately, the knurl pattern may be employed along any portion of the length and width of the interior surface of the electrical contact that makes contact with at least a portion of a lead of a wire cable.

In another alternate embodiment, the wire assembly may be associated with an electrical connection system used in any type of electrical application that requires a robust electrical connection.

In yet another alternate embodiment, the inner core of a wire cable may include a lead that has a plurality of wire strands that are compacted or welded together. One such welded lead is described in U.S. application Ser. No. 13/168,309 entitled CRIMP CONNECTION TO ALUMINUM CABLE filed on 24 Jun. 2011, which is incorporated by reference herein.

Alternately, the serration may be employed in the interior surface of the electrical contact without a corresponding knurl pattern also being employed. The serration also may take any patterned form on the interior surface that is different that a straight line that is perpendicular to the axis. In a further alternate embodiment, the serration may be disposed rearward of the knurl pattern closer to the rearward edge of the portion of the electrical contact. Still yet alternately, any number of serrations may be employed in the electrical contact. These multiple serrations may be defined in the interior surface at any location along the interior surface along with being employed with or without a corresponding knurl pattern.

In yet another alternate embodiment the die press used to form the serration in the embodiment of FIGS. 13 and 13A may also be formed in a manner having an overall rectangular shape yet form the serration of the embodiment illustrated in FIG. 14.

Thus, an electrical contact that includes a channel that has an angled sidewall and a knurl has been presented. The angled sidewalls of the channel with a ramp angle of less than 84 degrees allow for a more gradual extrusion of the aluminum lead into the serration to engage against the sidewalls and recessed surface of the channel that assists to prevent damage to the individual wire strands that may otherwise make the wire conductor/electrical conduct connection less electrically and mechanically robust. A channel with these features allow the aluminum lead to completely extrude into the channel without a void being present that ensures a robust electrical connection with the contact element. Each recessed rhombic element of the knurl pattern has an orientation relative to a wire cable received in the electrical contact that allows for an improved electrical and mechanical connection between the electrical contact and the aluminum wire cable. Each recessed rhombic element has an axial minor distance disposed between axial inner corners. Each rhombic element further includes a major distance disposed between non-axial inner corners. The axial minor distance is less than the major distance. The recessed rhomboid elements may be disposed along any amount of the interior surfaces of the electrical contact that axially receives a lead of the wire cable. The knurl pattern extends along a width of the core wings and along an arcuate base of the electrical contact defined in an interior surface of the electrical contact. The crimping process maintains the arcuate form of the base while also crimping the core wings in an arcuate form all that way from a neutral state to a final state as the crimp connection is constructed. This crimping process allows at least a substantial portion of the recessed rhomboid elements to fill with the extruded aluminum of the lead before the recessed rhomboid elements are partially closed to ensure voids in the recessed elements do not occur when the crimp connection is formed. When a substantial portion of the recessed rhomboid elements are filled with pure aluminum where the pure aluminum makes complete contact with a substantial portion of the surface area of the recessed surface of the rhomboid elements, a greater surface contact area between the aluminum lead and electrical contact is realized that ensures an enhanced mechanical and electrical crimp connection is attained over the service life of the wire assembly. The increased perimeter distance of the summation of the edges in the plurality of elements of the knurl pattern in combination with the axial minor distance orientation of each rhomboid element ensure the aluminum oxides disposed on the lead of the wire cable are more effectively fractured and broken along at least the outer surface of the lead along the length of the lead that is encompassed by the knurl pattern when the crimp connection is formed. A fluid conformal coating that covers the lead of the wire cable ensures a further corrosion-resistant layer that further provides a robust electrical and mechanical connection when a crimp is formed between the electrical contact and the lead. A two piece combination punch allows for the rhombic knurl pattern and the serration having a ramp angle of less than 84 degrees on a terminal to be manufactured on high volume manufacturing assembly line. A serration positioned forward of the rhombic knurl pattern on the internal surface of the terminal may provide the advantage of allowing for the desired growth during the material stamping process to produce the knurl pattern and the serration without being restrained by the stamp tooling being impressed in to the material stock.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical contact comprising:

at least one grooved channel defined in an interior surface of the electrical contact along at least a portion of the electrical contact disposed along a longitudinal axis and configured to axially receive a lead of a wire cable for attachment thereto such that the attached lead engagingly makes contact against a recessed surface of said at least one grooved channel, wherein said at least one grooved channel has a depth and includes at least one sidewall extending along the depth and the at least one sidewall includes at least one section thereof that angularly extends from the interior surface of the electrical contact to a point recessed from the interior surface disposed on the at least one sidewall along the depth; and a knurl pattern defined in the interior surface of the electrical contact along the portion of the electrical contact, the portion of the electrical contact configured to axially receive the lead of the wire cable for attachment thereto thereby allowing the lead to engagingly contact against the knurl pattern, the knurl pattern including a plurality of elements, each element in the plurality of elements has a shape that includes a plurality of inner corners, a first pair of opposing inner corners defining a generally axial minor distance therebetween and a second pair of opposing inner corners different from said first pair of opposing inner corners defining a major distance therebetween, wherein said generally axial minor distance is less than said major distance.

2. The electrical contact according to claim 1 wherein the knurl pattern is disposed on the interior surface intermediate the at least one grooved channel and a rearward edge of the portion.

3. The electrical contact according to claim 1, wherein said at least one section of the at least one sidewall is an inclined ramp extending in an outbound direction away from the recessed surface being disposed from said point to said interior surface so that the inclined ramp thereat is sloped at a ramp angle, and the ramp angle is in relation to a horizontal plane defined through the point and the horizontal plane has a generally parallel relationship with the interior surface, wherein the ramp angle has a value that is within a range associated with an acute angle.

4. The electrical contact according to claim 1, wherein said point is disposed at the recessed surface.

5. The electrical contact according to claim 4, wherein the at least one sidewall is an inclined ramp extending in an outbound direction away from the recessed surface being disposed from said point disposed at the recessed surface to said interior surface so that the inclined ramp is sloped at a ramp angle, and the ramp angle is in relation to a horizontal plane defined along the recessed surface and defined through the point, and said horizontal plane has a parallel relationship with the interior surface, and the ramp angle has a value that is within a range associated with an acute angle, wherein the acute angle has a maximum angular value of less than 84 degrees.

6. The electrical contact according to claim 1, wherein said at least one grooved channel has a width, and said width is disposed perpendicular to the longitudinal axis.

7. The electrical contact according to claim 1, wherein each element in the plurality of elements includes a surface having a spaced, recessed relationship to said interior surface.

8. The electrical contact according to claim 1, wherein each element in the plurality of elements includes a surface having an area that forms a rhombus shape.

9. The electrical contact according to claim 8, wherein the at least one grooved channel and the knurl pattern are formed in a two-piece die punch.

10. An electrical connection system comprising:

at least one connector that includes one or more electrical contacts and the one or more electrical contacts are in electrical connection with one or more wire cables, and the one or more electrical contacts includes, at least one grooved channel defined in an interior surface of the-one or more electrical contacts along at least a portion of the one or more electrical contacts disposed along a longitudinal axis and the at least a portion of the one or more electrical contacts configured to axially receive a lead of a wire cable for attachment thereto such that the attached lead engagingly makes contact against a recessed surface of said at least one grooved channel, wherein said at least one grooved channel has a depth and includes at least one sidewall extending along the depth and the at least one sidewall includes at least one section thereof that angularly extends from the interior surface of the one or more electrical contacts to a point recessed from an interior surface disposed on the at least one sidewall along the depth, and a knurl pattern defined in the interior surface of the one or more electrical contacts along the at least a portion of the one or more electrical contacts along the longitudinal axis and configured to axially receive the lead of the one or more wire cables for attachment thereto thereby allowing the lead to engagingly contact against the knurl pattern, the knurl pattern including a plurality of elements, each element in the plurality of elements has a shape that includes a plurality of inner corners, a first pair of opposing inner corners defining a generally axial minor distance therebetween and a second pair of opposing inner corners different from said first pair of opposing inner corners defining a major distance therebetween, wherein said generally axial minor distance is less than said major distance.

11. The electrical connection system according to claim 10, wherein said at least one section of the at least one sidewall is an inclined ramp extending in an outbound direction away from the recessed surface being disposed from said point to said interior surface so that the inclined ramp is sloped at a ramp angle, and the ramp angle is in relation to a horizontal plane defined through the point, and said horizontal plane has a generally parallel relationship with the interior surface, and the ramp angle has a value that is within a range associated with an acute angle.

12. The electrical connection system according to claim 10, wherein said point is disposed at the recessed surface.

13. The electrical connection system according to claim 12, wherein the at least one sidewall is an inclined ramp extending in an outbound direction away from the recessed surface being disposed from said point disposed at the recessed surface to said interior surface so that the inclined ramp is sloped at a ramp angle, and the ramp angle is in relation to a horizontal plane defined along the recessed surface and through the point, and said horizontal plane has a parallel relationship with the interior surface, and the ramp angle has a value that is within a range associated with an acute angle, wherein the acute angle has a maximum value of less than 84 degrees.

14. The electrical connection system according to claim 10, wherein each element in the plurality of elements includes a surface having a spaced, recessed relationship to said interior surface.

15. The electrical connection system according to claim 10, wherein each element in the plurality of elements includes a surface that comprises a rhombus shape.

16. The electrical connection system according to claim 15, wherein the surface that comprises the rhombus shape of each element in the plurality of elements has a spaced, recessed relationship to said interior surface.

17. The electrical connection system according to claim 10, wherein said one or more electrical contacts in electrical connection with the one or more wire cables are associated with a wiring harness disposed in a motorized vehicle.

* * * * *